United States Patent [19]

Egashira

[11] Patent Number: 4,890,114

[45] Date of Patent: Dec. 26, 1989

[54] ANTENNA FOR A PORTABLE RADIOTELEPHONE

[75] Inventor: Yoshimi Egashira, Kanagawa, Japan

[73] Assignee: Harada Kogyo Kabushiki Kaisha, Tokyo, Japan

[21] Appl. No.: 186,805

[22] Filed: Apr. 27, 1988

[30] Foreign Application Priority Data

Apr. 30, 1987 [JP] Japan ..... 62-65678[U]

[51] Int. Cl.[4] ..... H01Q 1/24

[52] U.S. Cl. ..... 343/702; 343/872; 343/901

[58] Field of Search ..... 343/900, 901, 903, 883, 343/880, 872, 702

[56] References Cited

U.S. PATENT DOCUMENTS

| | | | |
|---|---|---|---|
| 1,903,811 | 4/1933 | Gebhard et al. | 343/702 |
| 4,205,319 | 5/1980 | Gasparaitis et al. | 343/702 |
| 4,598,295 | 7/1986 | Murphy | 343/702 |
| 4,725,845 | 2/1988 | Phillips | 343/702 |

*Primary Examiner*—William L. Sikes

*Assistant Examiner*—Robert E. Wise

*Attorney, Agent, or Firm*—Koda & Androlia

[57] ABSTRACT

An antenna for portable radiotelephones including an antenna element and antenna holder. The antenna element is covered by a non-conductive cover except for the tip and base ends which respectively have a cap and a sleeve, both made of conductive materials thereon. The antenna holder is made of conductive materials, fixed in a case of the telephone and is connected to a matching device. The antenna holder includes a fastening section and an engaging section and holds therein the antenna element so the antenna element can be pulled outside of and pushed back into the case. The fastening section engages with the cap of the antenna element when the antenna element is pulled outside of the case. Thus, the antenna element can be kept in a state of electrical continuity with the antenna holder, which is electrically connected to the matching device, at all times. That is, the antenna element of the present invention is responsive to call signals not only when the antenna element is pulled outside of the case, but also when it is pushed back into the case.

5 Claims, 2 Drawing Sheets

FIG.1(a)
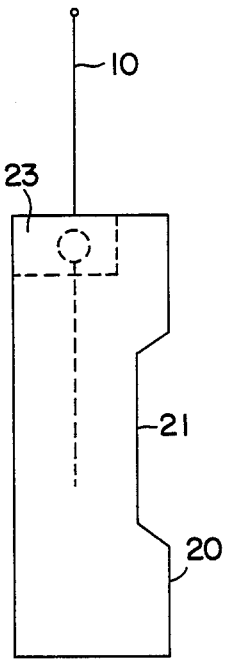
FIG.1(b)
FIG.2
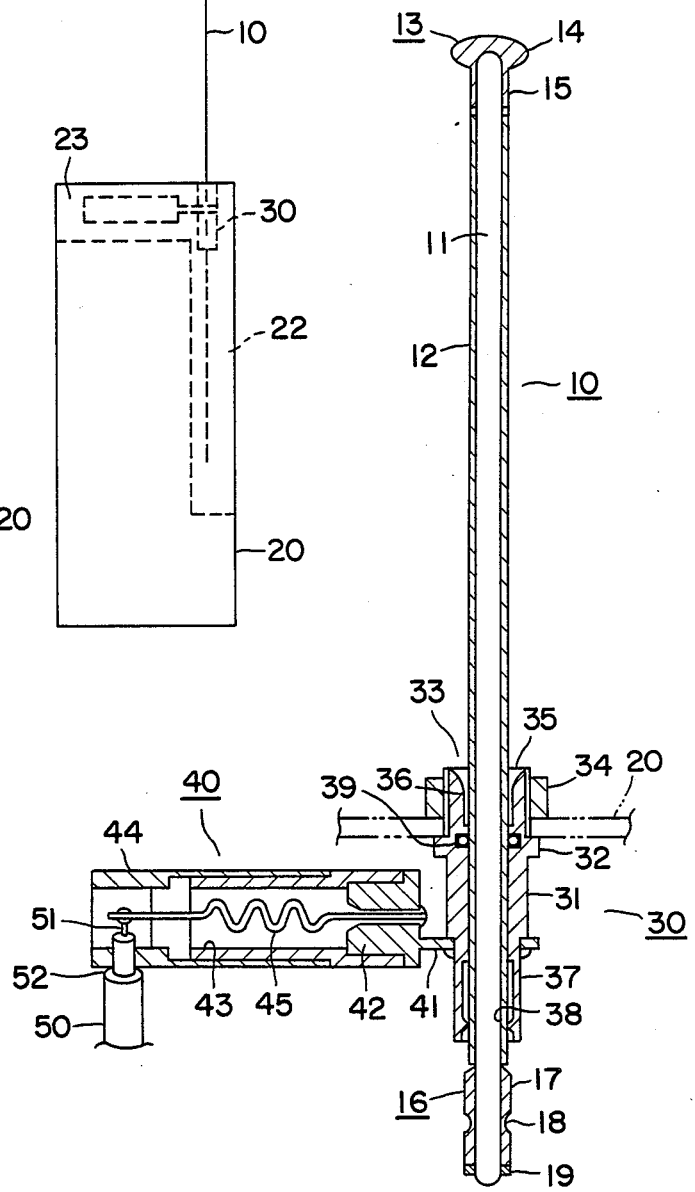

FIG. 3(a)
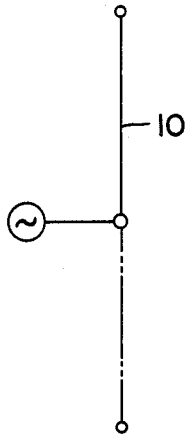
FIG. 3(b)
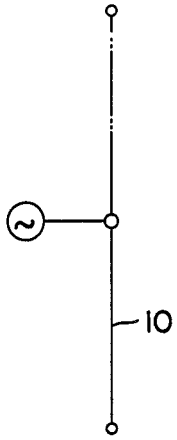
FIG. 4
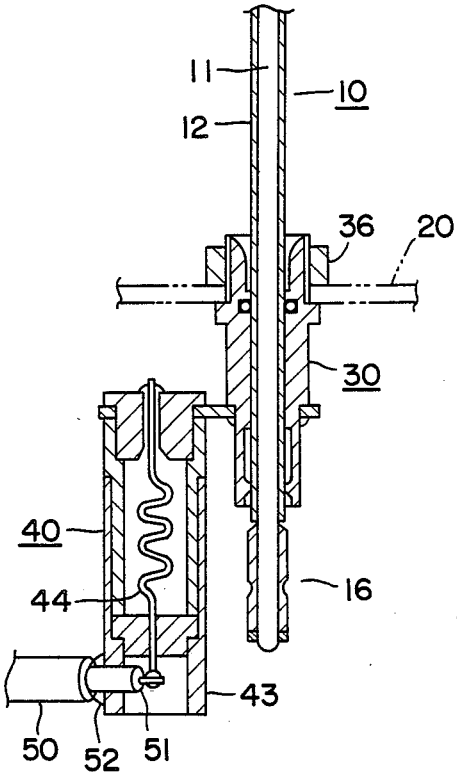
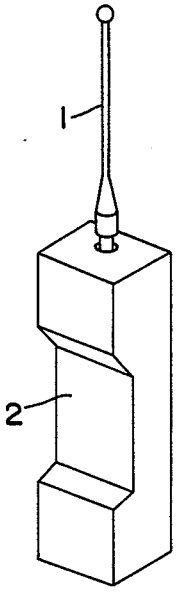
FIG. 5(a)
PRIOR ART
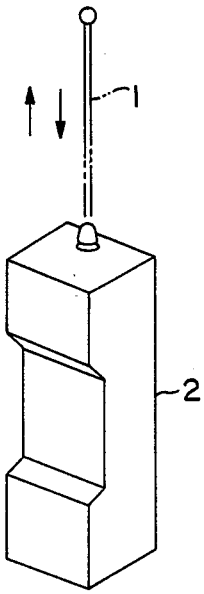
FIG. 5(b)
PRIOR ART

ANTENNA FOR A PORTABLE RADIOTELEPHONE

BACKGROUND OF THE INVENTION

1. Field of the Invention

The present invention relates to a transmitting and receiving antenna for a portable telephone, and more particularly to an accommodating device which accommodates an antenna element inside the case of a portable radiotelephone so that the antenna element can be freely inserted into or withdrawn from the case.

2. Prior Art

Telephones are instruments used for two-way communication, and portable telephones are no exception to this rule. Telephones used as instruments for such two-way communication have a substantial problem in that it is impossible to predict when a call signal will be received from a calling party. Accordingly, in the conventional portable telephones, as shown in FIG. 5(*a*), an antenna element 1 projects outside of the case 2, thus insuring that a call signal can always be received. Incidentally, the portable telephone case 2 has the shape of a transmitter-receiver used in ordinary telephones.

Since the antenna element 1 constantly projects outside of the case 2 in conventional antennas as described above, the antenna element 1 is a nuisance when the telephone is not in use. Accordingly, it is desirable for the antenna element to be retracted inside the case 2 when the telephone is not in use.

FIG. 5(*b*) illustrates a telephone designed so that the antenna element 1 is simply accommodated inside the case 2 so that it can be freely pushed into or withdrawn from the case in response the above-mentioned demand. In this construction, however, the transmission/reception sensitivity of the antenna element 1 drops remarkably when the antenna element 1 is accommodated inside the case 2. As a result, the above-mentioned intrinsic function of the telephone, i.e., "the ability to receive any call signals at any time," is reduced significantly.

SUMMARY OF THE INVENTION

Accordingly, a primary object of the present invention is to provide an antenna for a portable radiotelephone in which the antenna element can be accommodated inside the case of the radiotelephone so that the antenna element does not create a nuisance when the phone is not in use. Another object of the present invention is to provide an antenna for a portable radiotelephone in which a prescribed reception sensitivity can be maintained even when the antenna element is accommodated inside the case, so that the portable radiotelephone can be responsive to calls at all times.

In order to accomplish the objects of this invention, a unique structure is provided for an antenna for portable radiotelephones wherein a rod-form transmitting and receiving antenna element which can be freely pushed into or withdrawn from the case of a portable radiotelephone is held by an antenna-retaining mechanism which is equipped with a conductive part. This conductive part is kept in a state of electrical continuity with a feeding point of the antenna element both when the antenna element is extended outside of the case and when the antenna element is retracted in the case. A matching device, one end of which is connected to a conductive part of the above-mentioned antenna retaining mechanism, is installed inside the case, and the other end of this matching device is connected to the transmitter-receiver set of the radiotelephone by an appropriate connecting device such as a feeder cable, etc.

The following effect is achieved by the above-mentioned structure. Specifically, the feeding point of the antenna element is in a state of electrical continuity with the conductive part of the antenna-retaining mechanism not only when the antenna element is extended outside of the case but also when the antenna element is retracted inside the case. Accordingly, a practically unobstructed reception sensitivity can be maintained even when the antenna element is accommodated inside the case when the radiotelephone is not in use. As a result, the antenna element is accommodated inside the case, so that the antenna element does not create a nuisance when the phone is not in use. Also, it is always possible to respond to calls from any calling parties.

BRIEF DESCRIPTION OF THE DRAWINGS

FIGS. 1(*a*) and 1(*b*) are a side view and a front view which show the external appearance of the first embodiment of this invention;

FIG. 2 is a cross section which illustrates the structure thereof in a concrete manner;

FIGS. 3(*a*) and 3(*b*) illustrate the operation of this embodiment;

FIG. 4 is a cross section which illustrates the main parts of a second embodiment of this invention; and FIGS. 5(*a*) and 5(*b*) are perspective views which illustrate different examples of prior art.

DETAILED DESCRIPTION OF THE INVENTION

FIGS. 1(*a*) and 1(*b*) are a side view and a front view respectively, which illustrate the external appearance of one embodiment of this invention. FIG. 2 is a cross section of the construction of this embodiment in concrete manner.

In these Figures, reference numeral 10 indicates a rodform transmitting and receiving antenna element. As shown in FIG. 2, this antenna element 10 includes a flexible rod-form conductive part 11 wherein the circumference thereof, except for the tip portion (upper end in the figure) and base portion (lower end in the figure), is covered by a cover 12 which is a flexible material made of synthetic resin, etc.

A cap 13 which is formed of conductive materials is attached to the tip end of the rod-form conductive part 11 so that the cap 13 is in a state of electrical continuity with the rod-form conductive part 11. This cap has a flange-form expanded part 14 and a tube part 15 and is securely fixed in place by fixing the tube part 15 to the circumference of the tip end of the aforementioned rod-form part by a fixing means such as caulk, etc.

A conductive sleeve 16 is fastened to the base portion of the rod-form conductive part 11 so that the sleeve 16 is in a state of electrical continuity with the rod-form conductive part 11. This conductive sleeve 16 includes a tube part 17 which has an annular indentation 18, running in the circumferential direction, formed in its central portion. The conductive sleeve 16 is fastened to the lower end of the rod-form conductive part 11 by a fastening washer 19. This antenna element 10 constructed as described above, is installed so that it can be freely pushed into or withdrawn from the case 20 of a portable radiotelephone.

As shown in FIGS. 1(*a*) and 1(*b*), this portable radiotelephone case 20 has roughly the same shape as a transmitter-receiver of in a conventional telephone. An indentation 21 which is used in order to grasp the radiotelephone is formed in the central portion of one side of the case 20, and an element accommodating space 22 is formed longitudinally along one side wall of the case for the purpose of accommodating the aforementioned antenna element 10 inside the case so the antenna element 10 can be freely pushed into or pulled out from the case. Furthermore, a matching device installation space 23 for the installation of a matching device (described below) is formed laterally along the top wall of the case. In addition, an antenna-retaining mechanism 30, or antenna holder, which holds the aforementioned antenna element 10 so that the antenna element is free to slide, is formed in the area where the two abovementioned spaces (22 and 23) intersect.

As shown in FIG. 2, the antenna-retaining mechanism 30 is constructed with a main body which includes a conductive tube 31. The aforementioned antenna element 10 can be inserted into the central hole of the conductive tub 31. A flange part 32 is formed around the circumference of this conductive tube 31, and the area above this flange part 32 acts as a fastening area 33.

The antenna-retaining mechanism 30 as a whole is fastened to the case 20 by causing this fastening part 33 to project outward from a fastening hole formed in the top wall of the case 20 so that the flange part 32 contacts the interior surface of the top wall of the case 20 and then tightening a fastening nut 34 down on threads formed around the circumference of the fastening part 33. The opening 35 in the fastening area 33 has a funnel shape in order to disperse stress generated when the flexible antenna element 10 swings to and fro. Furthermore, a small-diameter portion of the funnel-shaped opening 35 has a space 36 which fits into the tube part 15 of the antenna cap 13 when the antenna element 10 is retracted (and pushed) inside the case.

An engaging part 37 is formed at the lower end of the conductive tube 31. This engaging part 37 is in the form of a slot-cut cylinder which has engaging pawls 38 formed on its interior surface. The engaging pawls 38 fit into the annular indentation 18 of the conductive sleeve 16 when the antenna element 10 is extended to the outside of the case, so that the antenna element 10 is held in the predetermined extended position. The engaging part 37 and the space 36 constitute a conductive part which is in a state of electrical continuity with a feeding point of the antenna element 10, both when the antenna element 10 is extended to the outside of the case and when the antenna element 10 is retracted inside the case.

An O-ring 39 is mounted on the interior surface of the central hole of the antenna-retaining mechanism 30 in order to prevent rain water, etc., from seeping into the interior of the case 20 via the antenna element 10.

Reference numeral 40 is a matching device and one end of this matching device 40 is connected to the conductive part of the abovementioned antenna-retaining mechanism 30. The overall shape of the matching device 40 is cylindrical and is installed horizontally in the matching device installation space 23 of the case 20 so that the axis of the matching device 40 is perpendicular to the axis of the antenna element 10.

A cylindrical conductive connector 42 is installed at one end of the matching device 40. The conductive connector 42 has a connecting piece 41 and is electrically and mechanically connected to the conductive tube 31 of the antenna-retaining mechanism 30. The open end of an insulating tube 43, which has a bottom, is fit over the circumference of the cylindrical conductive connector 42. A ground-side conductive tube 44 is fit over the circumference of this insulating tube 43. A matching coil 45 is accommodated inside the central space of the cylindrical case formed by the cylindrical conductive connector 42, insulating tube 43 and ground-side conductive tube 44. One end of this matching coil 45 is passed through a central hole in the conductive connector 42 and is soldered in place. The other end of the matching coil 45 projects outside through the bottom of the insulating tube 43. One end of a coaxial feeder cable 50 is connected to this projecting end of the matching coil 45 and to the ground-side conductive tube 44.

The coaxial feeder cable 50 has a well-known structure in which a core conductor 51 and an outer conductor 52 are installed coaxially. As is shown in the Figures, the core conductor 51 at one end of the cable is soldered to the aforementioned projecting end of the matching coil 45, while the outer conductor 52 is soldered to the ground-side conductive tube 44. Furthermore, although this is not shown in the Figures, the core conductor and outer conductor at the other end of the coaxial feeder cable 50 are connected to a transmitter-receiver set located inside the portable radiotelephone case 20.

Next, the use and operation of the embodiment described above will be explained:

Under ordinary conditions, with the power supply of the portable radiotelephone switched ON, the antenna element 10 is extended outside of the case 20. Thus, the engaging pawl 38 in the engaging area 37 of the antenna-retaining mechanism 30 engages with the annular indentation 18 of the conductive sleeve 16 fastened to the base of the antenna element 10. Accordingly, the antenna element 10 is fixed in place in a predetermined extended position, and the feeding point of the antenna element 10 is electrically connected to one end of the matching device 40. Thus, the antenna element 10 is set in the state illustrated in FIG. 3(*a*), so that transmission and reception, i.e., communication with another communicating party can be accomplished using ultrashort waves in the range of 800 to 1000 MHz.

When the portable radiotelephone is not being used, i.e., is in a state of non-use, the antenna element 10 may be retracted inside the case 20. In this case, the antenna element 10 is accommodated inside the case 20 so that the antenna element 10 does not create a nuisance. Under these conditions, the tube part 15 of the cap 13 of the antenna element 10 is pushed into the space 36 in the fastening part 33 of the antenna retaining mechanism 30. Accordingly, the antenna element 10 is fixed in place in the prescribed retracted position, and the feeding point of the antenna element 10 is electrically connected to one end of the matching device 40. Thus, the antenna element 10 is set in the state illustrated in FIG. 3(*b*), so that a prescribed level of reception sensitivity can be maintained even though the antenna element 10 is accommodated inside the case 20. Accordingly, calls from a calling party can be responded to at all times.

Thus, in the above described embodiment, the feeding point of the antenna element 10 is in a state of electrical continuity with the conductive part of the antenna-retaining mechanism 30 not only when the antenna element 10 is extended outside of the case 20, but also when the antenna element 10 is retracted inside the case 20. Accordingly, a sufficient degree of reception sensitivity (approximately 40 to 60% of the sensitivity during normal use) can be maintained even when the antenna element 10 is accommodated inside the case. As a result, when the portable radiotelephone is not in use, calls from calling parties can still be responded even though the antenna element 10 is retracted inside the case 20.

FIG. 4 is a cross section which illustrates the construction of the main parts of a second embodiment of the present invention. This embodiment differs from the first embodiment in that the matching device 40 is installed so that its axis is roughly parallel to the axis of the antenna element 10. In this embodiment, the matching device 40 is closer to the accommodated antenna element 10 than it is in the first embodiment. As a result, the drop in the reception sensitivity is slightly greater. However, the results of experiments have shown that there is no serious practical problem even if the antenna is constructed as in this embodiment. Accordingly, the antenna assembly may be constructed according to this embodiment if required by the conditions of the space inside the case 20.

Furthermore, the present invention is not limited to the above described embodiments. For example, in the embodiments of the present invention, the matching device 40 and the transmitter-receiver set are connected by the feeder cable 50. However, it would also be possible to connect these parts directly via a printed circuit board, etc., without using the feeder cable 50. It goes without saying that many other modifications are possible within the limits of this invention which do not involve any departure from the essence thereof.

In the present invention, the rod-form transmitting and receiving antenna element is installed so that it can be freely pushed into or withdrawn from the case of a portable radiotelephone and is held by an antenna retaining-mechanism which is equipped with a conductive part that is in a state of electrical continuity with the feeding point of the antenna element both when the antenna element is extended outside of the case and when the antenna element is retracted inside the case. The matching device, one end of which is connected to the conductive part of the antenna-retaining mechanism, is installed in the case, and the other end of this matching device is connected to the transmitter-receiver set of the radiotelephone by an appropriate connecting means. Accordingly, the antenna element can be accommodated inside the case when the radiotelephone is not in use, so that the antenna element does not create a nuisance. Furthermore, the prescribed reception sensitivity can be maintained even when the antenna element is accommodated inside the case, so that calls from calling parties can be responded to at all times.

I claim:

1. An antenna for a portable radiotelephone characterized in that said antenna comprises:

a rod-form transmitting and receiving antenna element arranged and configured such that substantially all of said antenna element can be freely inserted into or withdrawn from a case of said radiotelephone;

an antenna-retaining mechanism which holds said antenna element in a freely slidable manner and is equipped with a conductive part for making an electrical connection with a feeding point of said antenna element located at one end of said antenna element when said antenna element is extended outside of said case, and with a feeding point of said antenna element located at another end of said antenna element when substantially all of said antenna element is retracted inside of said case, said antenna-retaining mechanism being secured to said case by a fastening section which is outside of said case and an engaging section which is inside of said case;

a matching device installed inside of said case, one end of said matching device being connected to a conductive part of said antenna-retaining mechanism; and a means for connecting the other end of said matching device to a transmitter-receiver set of said portable radiotelephone.

2. An antenna for portable telephones comprising:

an antenna element covered by a cover, which is made of non-conductive materials, except for a tip end and base end thereof, said tip end and base end being provided with a cap and a sleeve, respectively, both made of conductive materials;

an antenna holder substantially in a tubular shape made of conductive materials which is fixed on a case of a portable telephone and holds therein said antenna element such that said antenna element can be withdrawn from or inserted entirely into said case, said antenna holder comprising a fastening section which is outside of said case and an engaging section which is inside of said case, said fastening section coming into contact with said cap and said engaging section with said sleeve.

3. An antenna according to claim 2, further comprising a matching device which is in contact at one end with said antenna holder and is in contact at the other end with a coaxial cable which is connected to a communication device provided in said case.

4. An antenna according to claim 3, wherein said engaging section has engaging pawls on an interior surface and said sleeve has an annular indentation on an exterior surface which engage with said engaging pawls.

5. An antenna according to claim 3, wherein said cover is made of synthetic resin.

* * * * *